US006149514A

United States Patent [19]

Maury

[11] Patent Number: 6,149,514

[45] Date of Patent: Nov. 21, 2000

[54] COVER FOR FOUNDATION VENTS, KIT AND METHOD FOR PRODUCTION THEREOF

[76] Inventor: Richard A. Maury, P.O. Box 265 36245 S. Whitney Bay Rd., Drummond Island, Mich. 49726

[21] Appl. No.: 09/515,136

[22] Filed: Feb. 29, 2000

[51] Int. Cl.[7] ..... F24F 13/20

[52] U.S. Cl. ..... 454/276; 49/466; 52/302.7; 454/271

[58] Field of Search ..... 454/254, 259, 454/271, 276, 277, 278, 283, 367; 49/463, 466; 52/302.7

[56] References Cited

U.S. PATENT DOCUMENTS

| | | | |
|---|---|---|---|
| 1,798,350 | 3/1931 | Parizek . | |
| 2,793,721 | 5/1957 | Sterud . | |
| 2,821,895 | 2/1958 | Allabaugh . | |
| 2,889,900 | 6/1959 | Singleton . | |
| 2,995,079 | 8/1961 | Fontaine . | |
| 3,001,332 | 9/1961 | Wilder . | |
| 3,115,082 | 12/1963 | Sanoff . | |
| 3,388,520 | 6/1968 | Perry . | |
| 3,704,563 | 12/1972 | Waller | 49/463 |
| 3,753,323 | 8/1973 | Nesbitt . | |
| 4,026,082 | 5/1977 | Crofoot . | |
| 4,270,311 | 6/1981 | Palomar . | |
| 4,325,229 | 4/1982 | DeZurik . | |
| 4,469,018 | 9/1984 | Taulman . | |
| 4,709,624 | 12/1987 | Croft | 454/367 |
| 4,735,132 | 4/1988 | Ching . | |
| 4,794,852 | 1/1989 | Ee | 454/276 X |
| 5,192,244 | 3/1993 | Rose . | |
| 5,213,543 | 5/1993 | Clarino | 454/284 X |

*Primary Examiner*—Harold Joyce
*Attorney, Agent, or Firm*—Ian C. McLeod; Marry M. Moyne

[57] ABSTRACT

A method for fabricating a vent cover (10) with an insulating sheet (11) bonded on an inside face of an outer sheet (12). A sheet (11E) which serves as a gasket is provided on the inside face (12A) of the outer sheet. A kit (14) is provided with a preform (10A) for the cover. The preform is cut around the insulating sheet and not the outer sheet to provide the cover. The cover provides good insulation and is relatively resistant to damage from handling.

19 Claims, 6 Drawing Sheets

COVER FOR FOUNDATION VENTS, KIT AND METHOD FOR PRODUCTION THEREOF

FIELD OF THE INVENTION

The present invention relates to a cover for closing a vent in a building. Further, the present invention relates to a kit and method for producing the cover. In particular, the present invention relates to a cover which is formed by cutting an insulated sheet to fit in an opening for the vent and to provide a flexible seal around the opening for the vent.

DESCRIPTION OF RELATED ART

The prior art has described numerous types of closures for vents and the like for buildings, particularly houses. In general, the closures are covers which block the vent and which are held in place by various types of connectors between the cover and the building or the vent. Usually there is an insulating material on an inside part of the cover which fits into an opening for the vent. There may also be gaskets between the cover and the vent. Illustrative of the prior art are: U.S. Pat. No. 1,798,350 to Parizek; U.S. Pat. No. 2,793,721 to Sterud; U.S. Pat. No. 2,821,895 to Allbaugh; U.S. Pat. No. 2,889,900 to Singleton; U.S. Pat. No. 2,995,079 to Fontaine; U.S. Pat. No. 3,001,332 to Wilder; U.S. Pat. No. 3,115,082 to Sanoff; U.S. Pat. No. 3,388,520 to Perry; U.S. Pat. No. 3,753,323 to Nesbitt; U.S. Pat. No. 4,270,311 to Palomar; U.S. Pat. No. 4,026,082 to Crofoot; U.S. Pat. No. 4,325,229 to DeZurik; U.S. Pat. No. 4,469,018 to Taulman; U.S. Pat. No. 4,735,132 to Ching and U.S. Pat. No. 5,192,244 to Rose.

The problem with these prior art devices is that they are pre-fabricated for a particular vent opening prior to distribution to the consumer. Vent openings come in a wide variety of shapes and sizes and thus such a pre-fabricated cover does not conveniently meet the needs of the supplier or consumer. There is a need for an improved type of cover enabling the consumer to easily custom fit the cover to a particular vent opening.

OBJECTS

It is therefore an object of the present invention to provide a method and kit for producing a vent cover which can be custom fitted to the opening for the vent. Further, it is an object of the present invention to provide a vent cover which is easily custom fitted to and sealed over the vent opening by the consumer and which is inexpensive. These and other objects will become increasingly apparent by reference to the following description and the drawings.

SUMMARY OF THE INVENTION

The present invention relates to a cover for closing a vent in an outside wall of a building which comprises:

(a) a first sheet of a closed cellular polymer material which fits into and closes an opening for the vent, the first sheet having opposed faces and sides between the faces;

(b) a seal material bonded on at least one of the faces of the first sheet, which seal material extends beyond the one of the faces of the first sheet; and (c) a second sheet of a material which resists cutting with a knife with opposed faces and sides between the faces with one of the opposed faces of the second sheet bonded to the seal material.

The present invention also relates to a building having vents in an outside wall, which comprises:

(a) a cover for the vents which comprises a first sheet of a closed cellular polymer material which fits into and closes an opening for the vent, the first sheet having opposed faces and sides between the faces; a seal material bonded on at least one of the faces of the first sheet, which seal material extends beyond the one face of the first sheet; and a second sheet of a material which resists cutting with a knife with opposed faces and sides between the faces with one of the opposed faces of the second sheet bonded to the seal material; and (b) securing means on the building for holding the cover over the vent.

The present invention also relates to a kit as a package containing a cover for closing a vent in an outside wall of a building which comprises:

(a) a first sheet closed cellular polymer material which fits into and closes an opening for the vent the first sheet having opposed faces and sides between the faces; a seal material bonded on at least one of the faces of the first sheet, and a second sheet of a material which resists cutting with a knife with opposed faces and sides between the faces, with one of the opposed faces of the second sheet bonded to the seal material; and (b) a securing means which is mountable on the building for holding the cover in the opening for the vent.

The present invention also relates to a method for forming a cover in an opening for a vent in a building which comprises:

(a) providing a first sheet of a closed cellular polymer material with opposed faces and sides between the faces; a seal material bonded on one of the faces of the first sheet and a second sheet of a material which resists cutting with a knife, the second material having opposed faces and sides between the faces with one of the faces of the opposed faces of the second sheet bonded to the seal material; and (b) cutting the first sheet with the knife so as to fit into and close the opening for the vent and so as to allow the seal material to contact a portion of the building around the opening.

The present invention also relates to a kit as a package for forming a cover for closing a vent in an outside wall of a building, which comprises:

(a) a first sheet of a closed cellular polymer material which is cuttable to fit into an opening for the vent with opposed faces and sides between the faces; and a second sheet of a material which resists cutting with a cutting instrument with opposed faces and sides between the faces, with one of the faces of the second sheet adhered to the first sheet; and (b) a securing means for holding the cover in the opening for the vent, wherein in use the cellular material is cut to fit the opening for the vent and the securing means holds the cover on the building.

Finally, the present invention relates to a method for forming a cover in an opening for a vent in a building which comprises:

(a) providing a first sheet of a cellular polymer material with opposed faces and sides between the faces of the first sheet and a second sheet of a material which resists cutting with cutting instrument which cuts with opposed faces and sides between the faces with one of the faces of the second sheet adhered to the first sheet; and (b) cutting the first sheet so as to fit into and close the opening for the vent and to allow the second sheet to extend around the opening to form the cover.

DESCRIPTION OF PREFERRED EMBODIMENTS

Figures 1, 2:
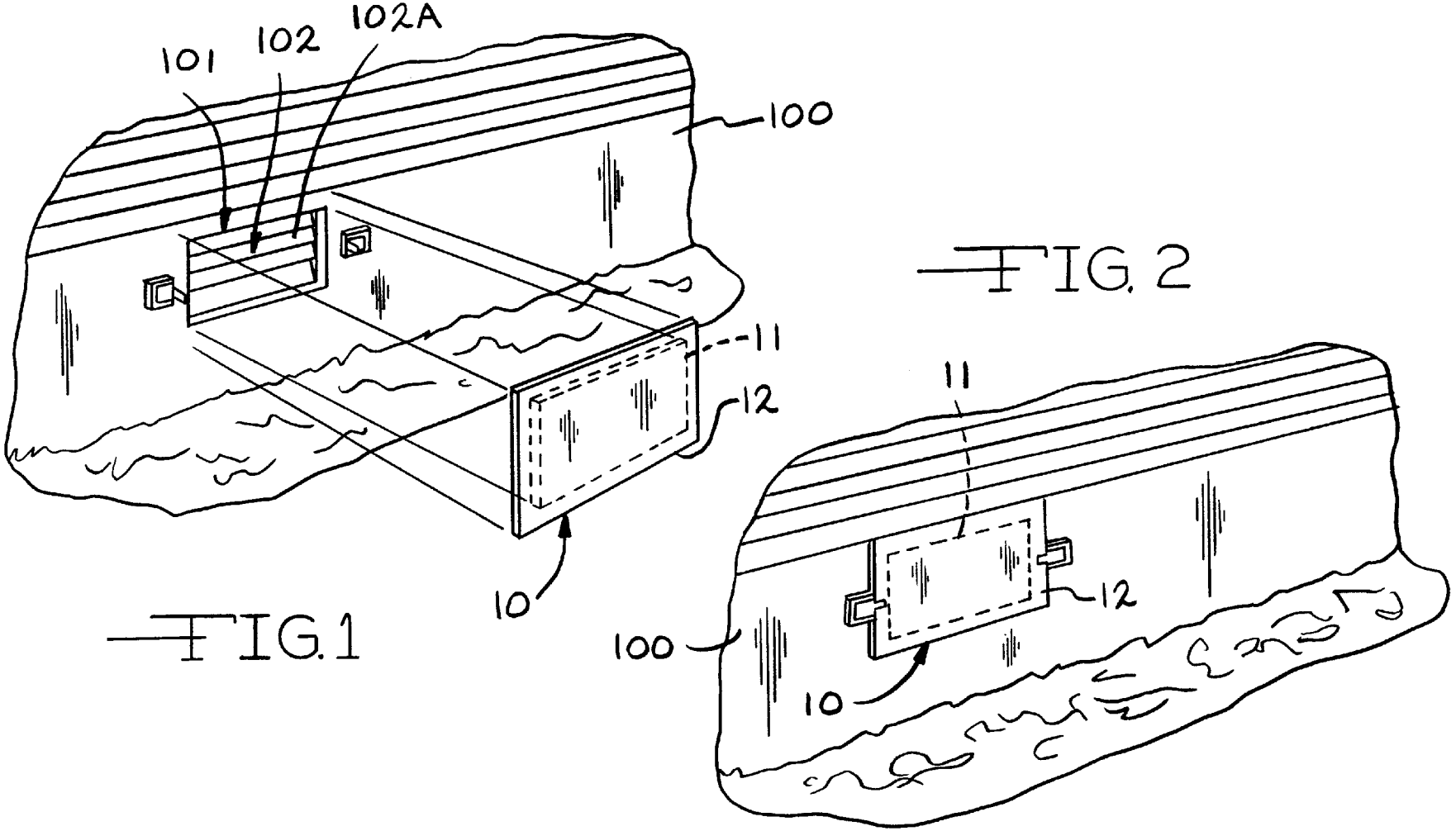
FIG. 1 is a front perspective view showing a cover 10 with an insulation sheet 11 on an inside face 12A of an outer sheet 12 separated from a building 100 having an opening 101 for vent 102 with louvers 102A.
FIG. 2 is a front perspective view of the cover 10 installed on the building 100 over and around the vent opening 101.
Figure 3:
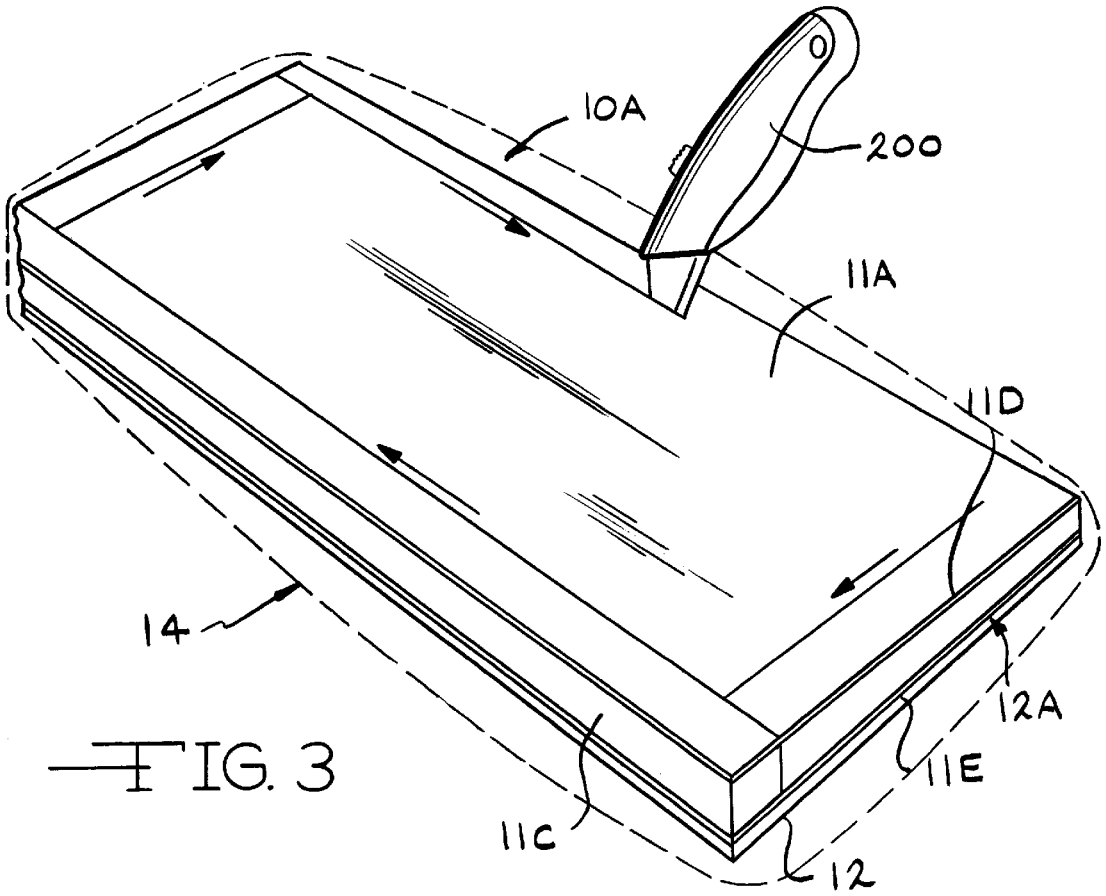
FIG. 3 is a front perspective view of a method step wherein the insulation sheet 11A of preform 10A is cut by the consumer to form the sheet 11.
Figure 4:
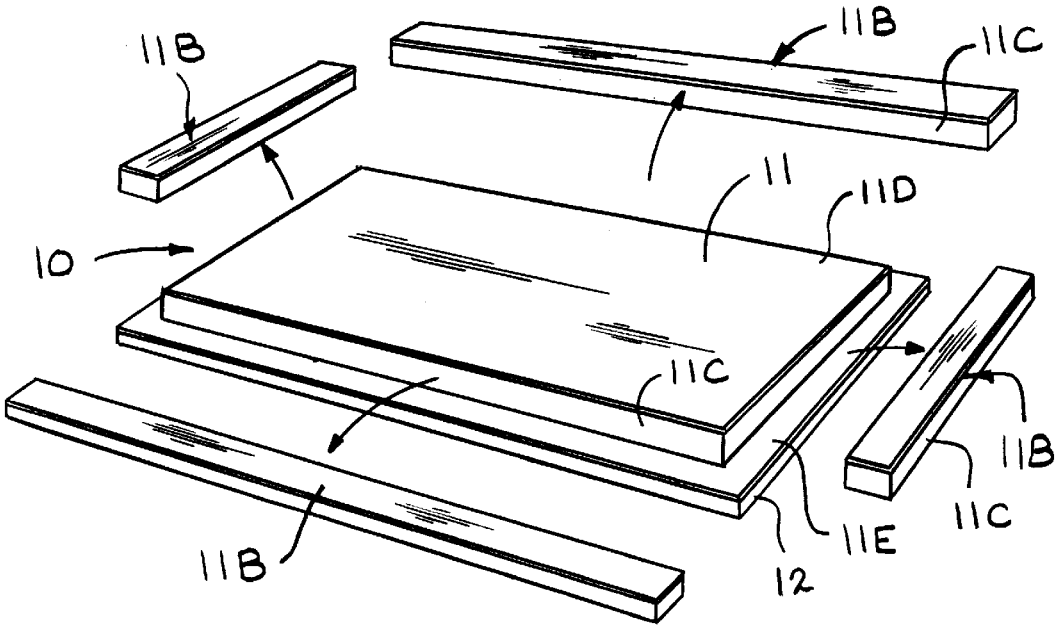
FIG. 4 is a front perspective view of the cover 10 with portions 101 of the insulation sheet 11A removed.
Figure 5:
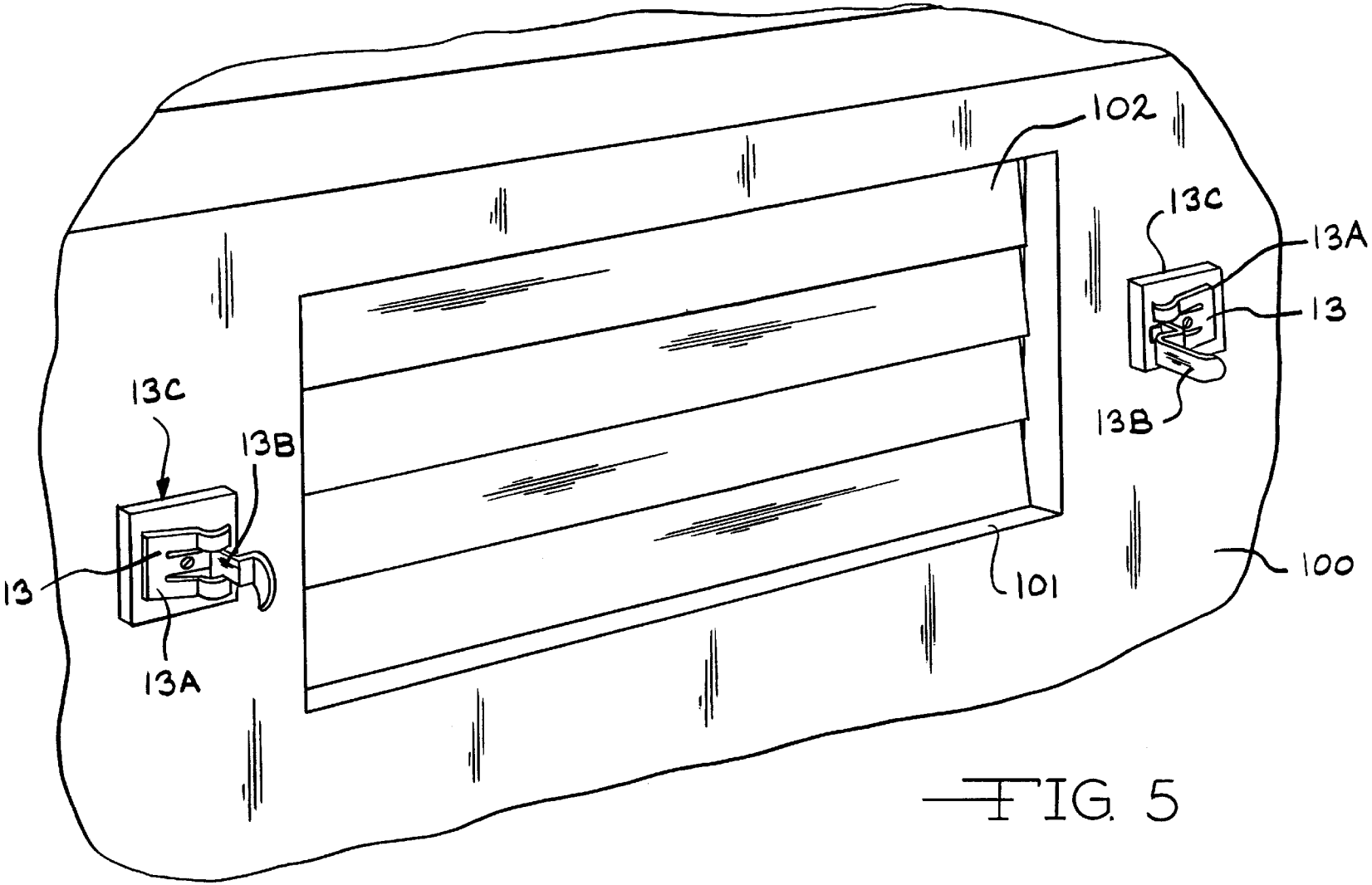
FIG. 5 is a front perspective view of the building 100, vent opening 101 and louvers 102A and spaced apart securing members 13.
Figure 6:
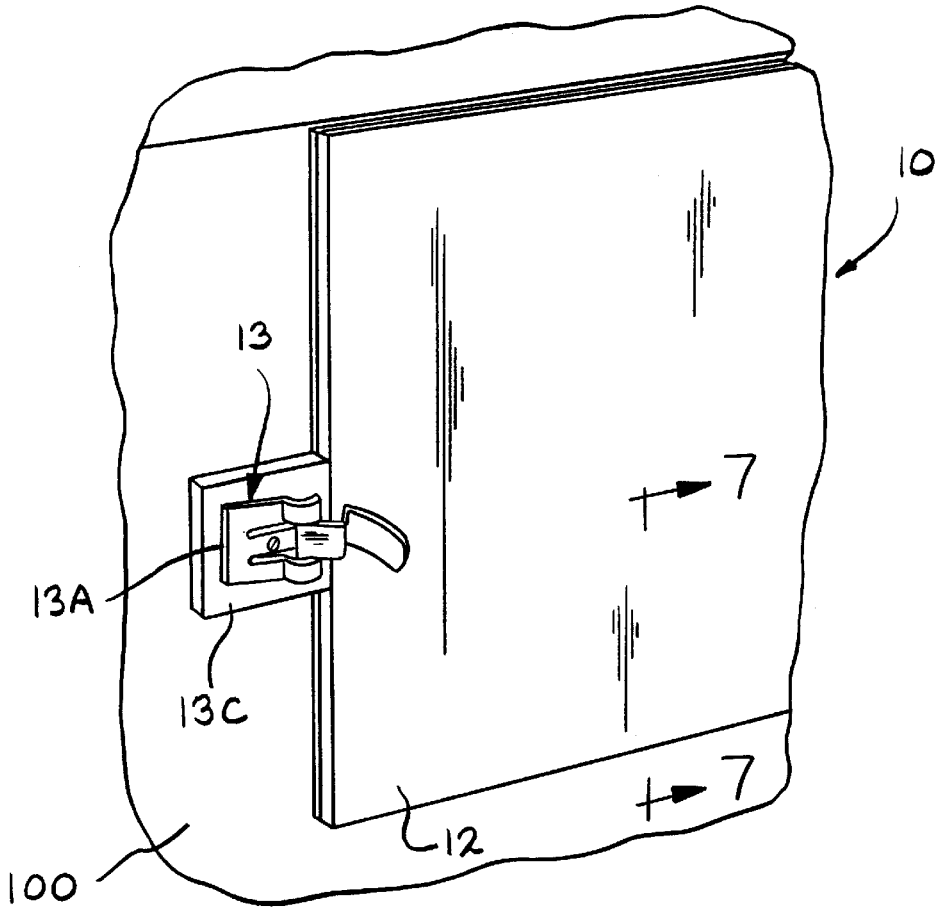
FIG. 6 is a front perspective view of the cover 10 held in place on building 100 by the securing members 13 pressing on sheet 12.

FIGS. 1 to 9 show various aspects of the vent cover 10 of the present invention. The cover 10 is positioned in the opening 101 in an outside wall of a building 100 or in an opening 101 in the foundation of a building 100 within which is located a vent 102 or 104 to prevent warm air from escaping from within the building 100 through the opening 101. The cover 10 includes an insulation sheet 11 and an outer sheet 12. As shown in FIGS. 3 and 4, the insulation sheet 11 includes a core 11C which is preferably constructed of an expanded, cellular material such as expanded polystyrene. Laminated to the core 11C, on opposing faces, are sealing sheets 11D and 11E of a gasket-like material (FIG. 4). In the preform 10A of the cover 10, the insulation sheet 11 is co-extensive with the outer sheet 12 of the cover 10 so that one of the sealing sheets 11E is able to be bonded to an inner face 12A of the outer sheet 12. The outer sheet 12 is preferably constructed of an expanded polyvinylchloride (PVC) which is a relatively harder material and more difficult to cut than the polystyrene. A knife 200 or other cutting instrument is used to cut the sheet 11D and core 11C of the insulation sheet 11 down to the sheet 11E. This enables the peeling of the portions 11B of the core 11C and sheet 11D to provide the cover 10.

The cuts are made by the consumer so that the size of the insulation sheet 11 fits the vent opening 101. The sealing sheet 11E which is bonded to the inner face 12A of the outer sheet 12 remains and serves as a gasket.

The remaining portion 11A of insulation sheet 11 has sealing sheet 11D on the exposed face which reduces damage to the core 11C which tends to be fragile. To construct the cover 10 from the preform 10A, all the consumer needs to accomplish is the cutting and removal of the portions 11B of the insulation sheet 11 so that the remaining portion 11A of the insulation sheet 11 provided on the outer sheet 12 is of the correct size to fit in the opening 101 in the building 100 for the vent 102 or 104.

Figure 7:
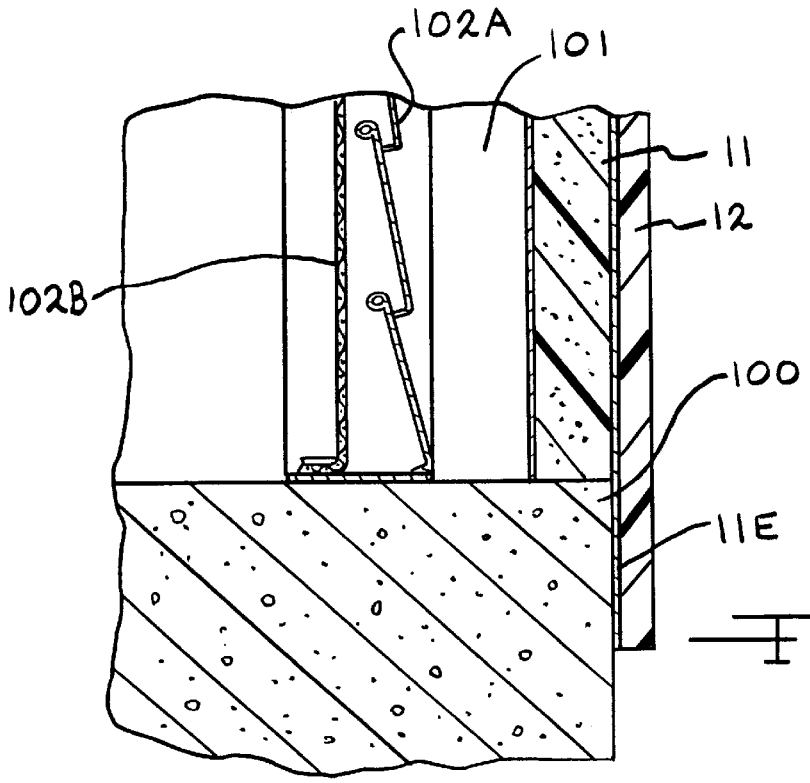
FIG. 7 is a cross-sectional view along line 7–7 of FIG. 6 showing the cover 10 in place on the building 100.
Figure 8:
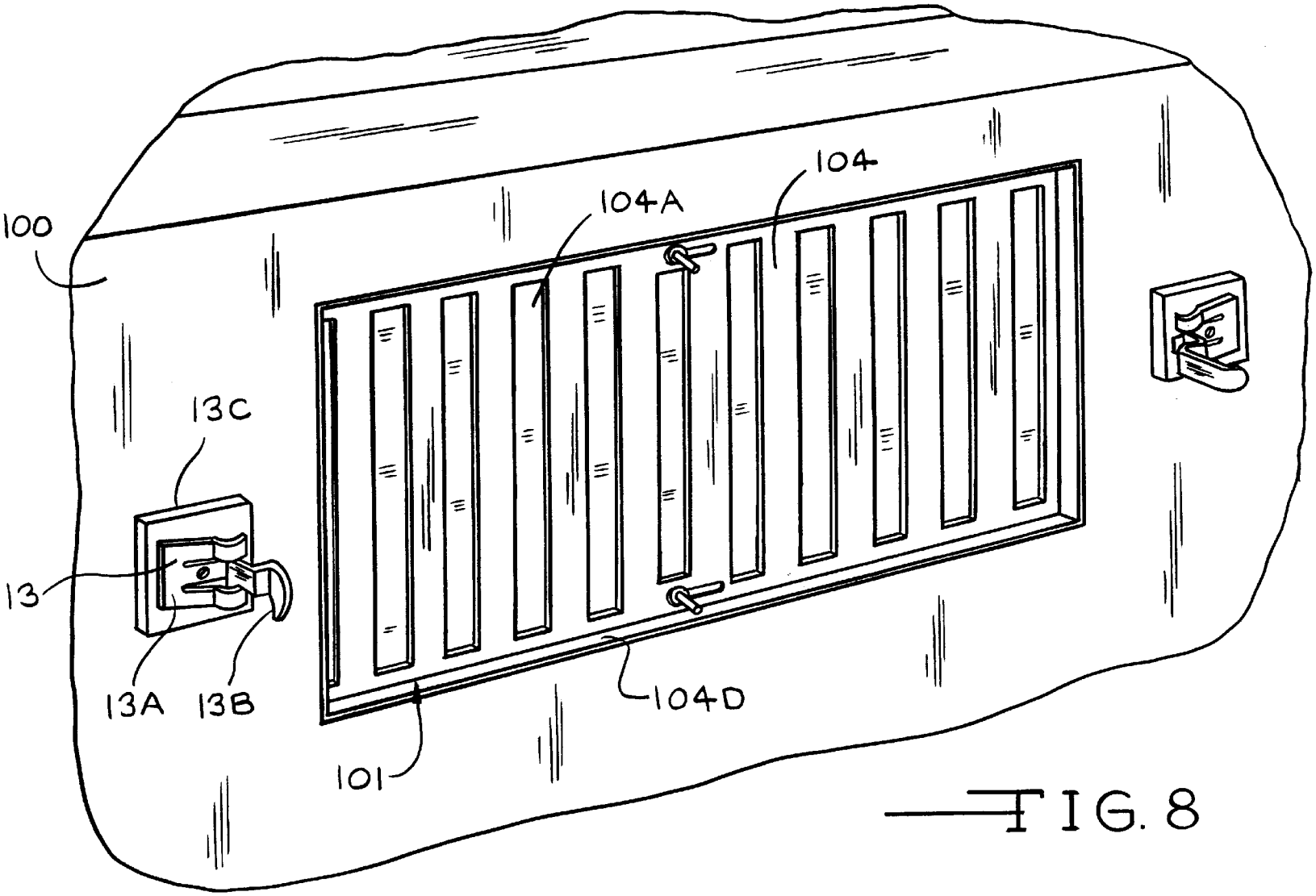
FIG. 8 is a front perspective view of the building 100 with a vent opening 101 showing the opening 104A of vent 104 of an alternative embodiment and showing the securing members 13.
Figure 9:
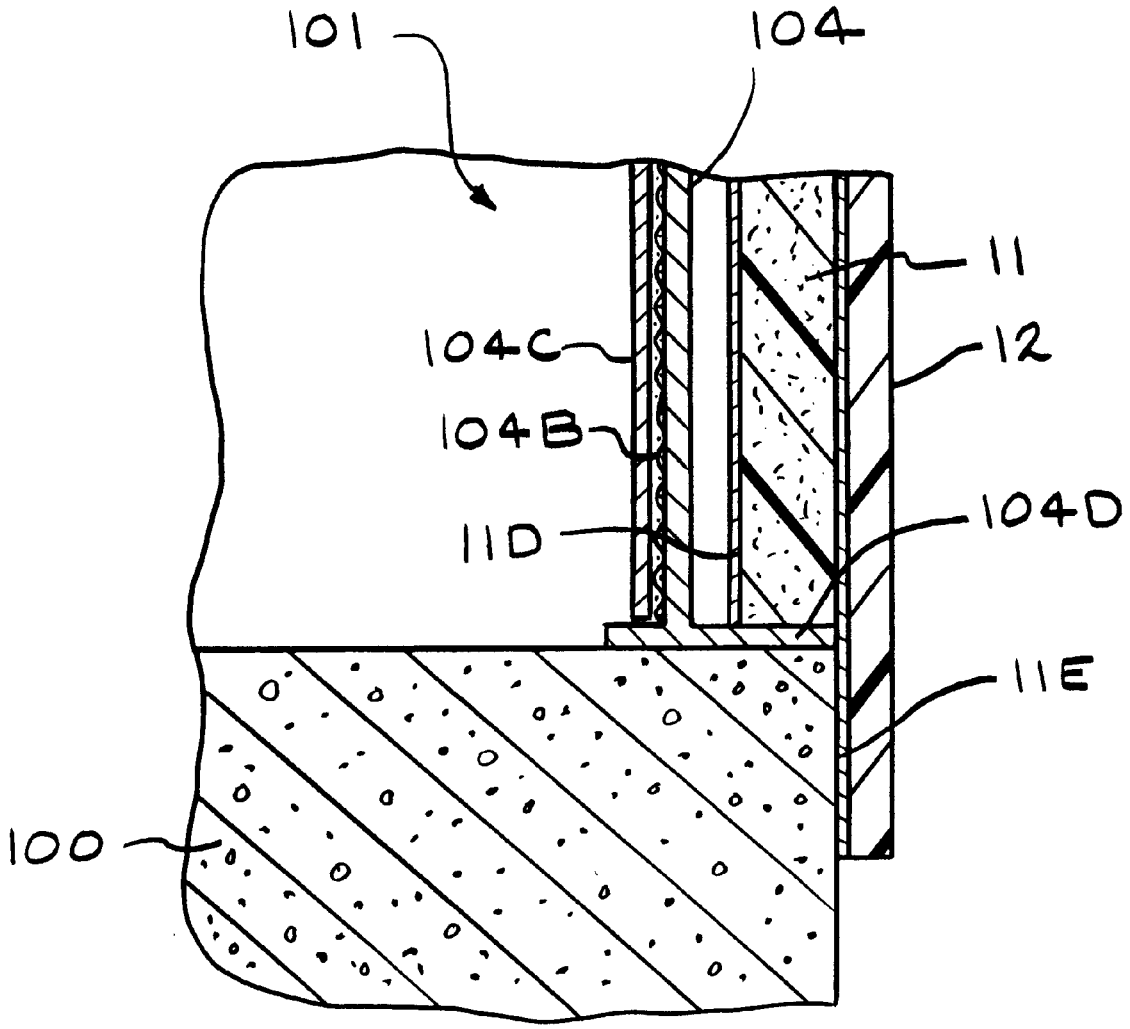
FIG. 9 is a cross-sectional view showing the cover 10 in place on the building 100 and covering the vent 104 of the alternative embodiment.

FIGS. 1, 5, 6 and 7 show the installation of the cover 10 which is fitted into opening 101 for a vent 102 preferably having louvers 102A (or a screen) and/or a screen 102B. Typically, the louvers 102A are manually pivotable so as to be opened and closed. In an alternative embodiment, as shown in FIGS. 8 and 9, the vent 104 has vertical openings 104A with a screen 104B adjacent the inside surface to cover the openings 104A. A sliding door 104C is provided behind the screen 104B on a side opposite the openings 104A and is manually and horizontally slidable to allow for opening and closing the openings 104A. In this embodiment, the frame 104D of the vent 104 extends to the outer edge of the opening 101 of the building 100 when the vent 104 is mounted in the opening 101. Thus, the insulation sheet 11 of the cover 10 must be cut to accommodate the frame 104D of the vent 104 (FIG. 9). In another alternative embodiment (not shown), the vent has a series of rectangular openings having a screen adjacent the inside surface of the openings. A flap is pivotably mounted along a top edge of the vent and is pivoted between a raised and lowered position to open and close the openings.

The core 11C and sheet 11D are preferably cut around and spaced inward from the perimeter of the outer sheet 12 such that when the cover 10 is positioned over the opening 101, the core 11C and sheet 11D extend into the opening 101 and the outer sheet 12 extends around the perimeter of the opening or adjacent and in contact with the building 100. This construction provides a positive seal between the sheet 11E and a face of the building 100 around the opening 101 (FIGS. 7 and 9).

In the preferred embodiment, the cover 10 is held in place over the opening 101 and the vent 102 or 104 by a pair of securing members 13 mounted on the outside wall of the building 100 adjacent the opening 101. Preferably, the securing members 13 have a spring member 13A and a rotatable latch 13B which engages the outer margin or perimeter of the outer face of the outer sheet 12 of the cover 10. Blocks 13C are provided to mount the securing members 13 to the building 100 so that the securing members 13 are aligned on the same plane with the outer sheet 12. The blocks 13C are preferably made of the expanded PVC.

In use, the consumer purchases a kit 14 which includes the preform 10A as shown in dotted lines in FIG. 3. The kit 14 may optionally include the knife 200. The customer measures the opening 101 in the building 100 having the vent 102 or 104. The customer then cuts the sheet 11D and core 11C to a size to fit the opening 101. In the preferred embodiment, the sheet 11D and core 11C are of a size as to closely fit within the opening 101. In the first alternative embodiment for the vent 104, the face sheet 11D and core 11C must be cut to allow for the frame 104D of the vent 104 (FIG. 9). Since the sheet 11E is bonded to the inner face 12A of the outer sheet 12, it does not make any difference that the sheet 11E is scored during cutting. The bond between the outer sheet 12 and the sealing sheet 11E is such that the core 11C can be pulled from the sealing sheet 11E. The core 11C is preferably made of a friable or frangible material, such that it is easily removed from the sheet 11E. The result is a neat and precise cover 10 for the opening 101 of the vent 102 or 104. The core 11C also preferably has a large R factor and thus is a good insulator. To remove the cover from the opening 101, the spring members 13A are moved from a closed position in contact with the outer sheet 12 of the cover 10 to an open position spaced apart from the outer sheet 12. The outer sheet 12 is then pulled away from the building 100.

It is intended that the foregoing description be only illustrative of the present invention and that the present invention be limited only by the hereinafter appended claims.

I claim:

1. A cover for closing a vent in an outside wall of a building which comprises:

(a) a first sheet of a closed cellular polymer material which fits into and closes an opening for the vent, the first sheet having opposed faces and sides between the faces;

(b) a seal material bonded on at least one of the faces of the first sheet, which seal material extends beyond the one of the faces of the first sheet; and (c) a second sheet of a material which resists cutting with a knife with opposed faces and sides between the faces with one of the opposed faces of the second sheet bonded to the seal material.

2. The cover of claim 1 wherein the first sheet and second sheet have rectangular faces and four sides.

3. The cover of any one of claims 1 or 2 wherein the first sheet of the cellular polymer material is a polystyrene foam.

4. The method of any one of claims 1 or 2 wherein the first sheet of the cellular polymer material is a polystyrene foam, the seal material is a deformable polymer and the second sheet is an acrylic or expanded vinyl polymer.

5. A building having vents in an outside wall, which comprises:

(a) a cover for the vents which comprises a first sheet of a closed cellular polymer material which fits into and closes an opening for the vent, the first sheet having opposed faces and sides between the faces; a seal material bonded on at least one of the faces of the first sheet, which seal material extends beyond the one face of the first sheet; and a second sheet of a material which resists cutting with a knife with opposed faces and sides between the faces with one of the opposed faces of the second sheet bonded to the seal material; and (b) securing means on the building for holding the cover over the vent.

6. The building of claim 5 wherein the first sheet and second sheet have rectangular faces and four sides.

7. The building of any one of claims 5 or 6 wherein the first sheet of the cellular polymer material is a polystyrene foam.

8. The building of any one of claims 5 or 6 wherein the first sheet of the cellular polymer material is a polystyrene foam, the seal material is a deformable polymer and the second sheet is an acrylic or expanded vinyl polymer.

9. The building of claim 5 wherein at least two of the securing means are attached to the building adjacent to the cover on opposite sides of the second sheet so as to hold the cover in the opening for the vent and wherein the securing means is movable away from the second sheet to allow the cover to be removed from the building.

10. The building of claim 9 wherein the securing means opens to remove the cover and closes onto an outside face of the second sheet to hold the cover in the opening.

11. A kit as a package containing a cover for closing a vent in an outside wall of a building which comprises:

(a) a first sheet closed cellular polymer material which fits into and closes an opening for the vent the first sheet having opposed faces and sides between the faces; a seal material bonded on at least one of the faces of the first sheet, and a second sheet of a material which resists cutting with a knife with opposed faces and sides between the faces, with one of the opposed faces of the second sheet bonded to the seal material; and (b) a securing means which is mountable on the building for holding the cover in the opening for the vent.

12. The kit of claim 11 wherein the cellular material is to be cut to form the cover.

13. The kit of claim 11 wherein at least two of the securing means are attached to the building adjacent to the cover on opposite sides of the second sheet so as to hold the cover in the opening for the vent and wherein the securing means is movable from the cover to allow the cover to be removed from the building.

14. The kit of claim 13 wherein the securing means opens to remove the cover from the vent and closes onto an outside face of the second sheet to hold the cover in the opening.

15. A method for forming a cover in an opening for a vent in a building which comprises:

(a) providing a first sheet of a closed cellular polymer material with opposed faces and sides between the faces; a seal material bonded on one of the faces of the first sheet and a second sheet of a material which resists cutting with a knife, the second material having opposed faces and sides between the faces with one of the faces of the opposed faces of the second sheet bonded to the seal material; and (b) cutting the first sheet with the knife so as to fit into and close the opening for the vent and so as to allow the seal material to contact a portion of the building around the opening.

16. The method of claim 15 wherein the first sheet and second sheet of material have rectangular faces and four sides and wherein the first sheet is cut inside of and around the sides of the second sheet.

17. The method of any one of claims 14 or 15 wherein the first sheet is a polystyrene foam which is cut to fit into the opening for the vent.

18. A kit as a package for forming a cover for closing a vent in an outside wall of a building, which comprises:

(a) a first sheet of a closed cellular polymer material which is cuttable to fit into an opening for the vent with opposed faces and sides between the faces; and a second sheet of a material which resists cutting with a cutting instrument with opposed faces and sides between the faces, with one of the faces of the second sheet adhered to the first sheet; and (b) a securing means for holding the cover in the opening for the vent, wherein in use the cellular material is cut to fit the opening for the vent and the securing means holds the cover on the building.

19. A method for forming a cover in an opening for a vent in a building which comprises:

(a) providing a first sheet of a cellular polymer material with opposed faces and sides between the faces of the first sheet and a second sheet of a material which resists cutting with cutting instrument which cuts with opposed faces and sides between the faces with one of the faces of the second sheet adhered to the first sheet; and (b) cutting the first sheet so as to fit into and close the opening for the vent and to allow the second sheet to extend around the opening to form the cover.

* * * * *